US005789749A

United States Patent [19]

Breton

[11] Patent Number: 5,789,749

[45] Date of Patent: Aug. 4, 1998

[54] PLASMA SUPERCONFINEMENT GENERATOR FOR PRODUCING POSITIVE OR NEGATIVE IONS IN A GASEOUS MEDIUM

[76] Inventor: Jacques Breton, 9 avenue de Gradignan, F-33600 Pessac, France

[21] Appl. No.: 765,825

[22] PCT Filed: Jul. 20, 1995

[86] PCT No.: PCT/FR95/00978

§ 371 Date: Mar. 21, 1997

§ 102(e) Date: Mar. 21, 1997

[87] PCT Pub. No.: WO96/02966

PCT Pub. Date: Feb. 1, 1996

[30] Foreign Application Priority Data

Jul. 20, 1994 [FR] France ..... 94 09247

[51] Int. Cl.[6] ..... H01T 23/00

[52] U.S. Cl. ..... 250/324; 361/231

[58] Field of Search ..... 250/324; 361/229, 361/230, 231

[56] References Cited

U.S. PATENT DOCUMENTS 3,711,710 1/1973 Wright ..... 361/230
4,227,235 10/1980 Bishop ..... 361/230

FOREIGN PATENT DOCUMENTS 2 517 893 6/1983 France .
2 687 858 8/1993 France .

*Primary Examiner*—Jack I. Berman
*Attorney, Agent, or Firm*—Young & Thompson

[57] ABSTRACT

The invention relates to a generator of ions in gaseous medium comprising at least one emissive needle (Ag) disposed in a system of plates ($P_2$, $P_4$, $P_5$) connected to a high voltage electrical source (Al), an insulating plate ensuring the diffusion of the electrons, and is characterized in that the needle (Ag) comprises a coaxial sheath (Gn) of a dielectric material of high resistivity, low loss and relatively high permissivity, extended by a first conical proximal section (Cp) of the same material, leaving exposed the emissive end of the needle, and itself extended by an open conical distal structure (Cd) of the same material as the sheath, in that said distal structure (Cd) is extended by a plate (Pi) of the same material as the sheath and constituting with the distal conical structure (Cd) said diffusion plate of the electrons and in that said extending plate (Pi) is fixed below a plate (P6) of a material of very low electrical conductivity, adapted to form a portion of the external housing of the generator.

Use particularly in the depollution/decontamination of localities and in the protection of sites sensitive to static charges.

13 Claims, 2 Drawing Sheets

PLASMA SUPERCONFINEMENT GENERATOR FOR PRODUCING POSITIVE OR NEGATIVE IONS IN A GASEOUS MEDIUM

The present invention relates to electronic devices of the "generators of negative or positive ions" type. These devices permit maintaining within an enclosure or a locality an ion density (for example of negative ions of oxygen $O_2$ in the air) for homogeneous or localized distribution, permanent or temporary, previously predetermined and also as high as necessary, in the absence of any production of harmful or toxic compounds (ozone $O_3$ and/or nitrogen oxides $NO_x$ among others).

Known devices of this type rely on the "corona" (or "point" effect). Acting with a voltage for example of −6 to −12 kV, a metallic point then emits an electron flux increasing rapidly (exponentially) with the applied voltage.

The known defects of these devices, inherent in their emissive structure, however limit drastically their performances, and more particularly the interest and the possibilities of uses. In particular, the rudimentary emission configuration generally adopted gives rise to inevitable consequences:

- the necessary use of very high voltages (8 to 12 kVolts) indispensable for the production of a sufficient ion flux, but difficult to control or even dangerous for present applications,
- the uncertain value of the electrical field existing adjacent the emissive point,
- the drawback of a mediocre ion output,
- the existence of an extended plasma zone, created at the end of the points, favoring intense production of peroxidizers already cited and harmful by the screen effect at the ionic emission intensity,
- the dispersion in the atmosphere of toxic compounds thus produced, promoted by the "electrical wind" resulting from very high voltages used,
- the excessive directedness of the electronic emission, producing a very inhomogeneous ambient ionic density,
- the virtual requirement to use a "propulsor" which is costly in useless energy, noisy, subject to wear (fan, turbine . . . ), a cause of undesirable turbulence in the air (blowing into suspension the pollutants that are present) and troublesome, exaggerating still more the directedness of the device.

Such faults were largely improved, and certain were overcome in devices provided with "the electronic optics" according to the patents FR-A-2 603 428 and FR-A-2 687 858. However, several defects remained which were inherent in the configuration adopted:

- it was difficult to avoid start up between the emissive needles and the field plate (connected to the mass and to the ground), due to the necessarily limited diameter of the openings of said plate (maximum "folding back" necessary for the equally potential zero),
- inevitable capture by the field plate and the walls, of the charges from the needles by the lateral corona effect (discharge), giving rising to a substantial loss of output,
- a still insufficient limitation of the confinement of the plasma, due to partial "folding back" of the equipotential zero, resulting from the large diameter of the openings of the field plate,
- excessive capture of the charges emitted by the walls of the casing, thereby reducing the output of the device.

The new device according to the invention seeks to overcome the defects recited above, and is thus exempt from the recited drawbacks. The experimental control (measurements in a Faraday cage or global flow) of an embodiment of said new device permits verifying the effective disappearance of the mentioned defects.

To this end, the invention has for its object a generator of positive or negative ions in a gaseous medium, comprising electronic optics constituted by at least one emissive needle or point disposed in a system of support and acceleration plates, focussing and diffusing the ions, comprising a first conductive plate on which is secured the non-emissive end of the needle, a second conductive plate traversed by said needle and provided, on its surface turn toward said first conductive plate, an insulating plate, said first and second conductive plates being connected to a suitable source of high voltage electricity and an insulating plate arranged at the height of the emissive end of the needle and ensuring the diffusion of the electrons emitted by the needle, characterized in that the needle comprises a coaxial sheath of a dielectric material with high resistivity, low loss and relatively high permissivity, in that the portion of said sheath located on the side of the emissive end of the needle is extended by a first proximal conic section of the same material as the sheath and leaving exposed said emissive end, in that said proximal section is extended by an open conical distal structure of the same material as the sheath, in that said distal conical structure is extended by a plate of the same material as the sheath and constituting with the distal conical structure said diffusion plate for the electrons and in that said extending plate is fixed below a plate of a material of very low electrical conductivity, adapted to form a portion of the external casing of the generator.

Other characteristics of the device of the invention are defined in the dependent claims.

The generator of the invention is therefore characterized in a general manner by complete sheathing of each of the emissive needles, extended by a suitable emission structure, the assembly constituted by a dielectric with high resistivity and low losses, of relatively high permissivity, associated with a reorganization of the electronic optical elements. This sheathing, this suitable structure and the reorganization of the electronic optics thus assures the multiple advantages which follow, permitting in particular:

- reducing to the minimum possible the diameter of the openings of the field plate,
- ensuring in this way the maximum possible "folding back" of the equipotential zero (by the effect of the configuration of the electrical field within the dielectric),
- thereby ensuring an unequivocal relation between the selected parameters and the fixed value of the electric field at the end of the needles,
- thereby obtaining the value near the maximum possible of said electrical field at the end point of the emissive needles,
- thereby approaching the maximum possible of the electronic emission of the needles,
- thereby avoiding recourse to very high voltages of use which would be difficult or dangerous, with inevitable supplemental generation of the mentioned toxic compounds,
- reducing to the minimum possible the volume of the plasma zone at the free end of the needles ("superconfinement" mechanism), reducing further, even cancelling, the production of the mentioned peroxidants, totally suppressing any risk of starting with the field plate, totally cancelling the losses by the lateral corona effect of the needles, thereby suppressing all supplemental generated outflow of toxic compounds, thereby ensuring optimum intrinsic ionic output of the emissive needles, thus disposing the free end of the needles in the optimum geometric configuration vis-a-vis the external plate of the housing enclosing the device, so as to give maximum electronic emission toward the atmosphere, thereby reducing the diameter of the openings of said plate, thus providing an increased number of emissive needles over a same surface, excluding any useless "propulsive" system of the air preliminarily ionized, and thereby avoiding inevitable nuisances, thus reducing to the absolute minimum, if necessary and without adverse effect on output, the external size of the device by facilitating its use, finally reducing to the indispensable minimum the energy consumption of the device.

The device according to the invention thus ensures the production, the emission and the quasi-isotropic diffusion of an intense flux of charges of one and/or the other sign, without emission of toxic compounds, under a voltage of moderate value, without useless expenditure of energy. Such characteristics are absent in all or a portion of all the other devices with emissive points now used.

As a result, there is a certain and decisive improvement of the "corona effect" generator, both as concerns the size of the flux emitted and its spatial distribution (quasi-isotropic), the increased safety of its use, the total and definitive absence of all danger caused to persons or to sensitive installations, due to the absence of emission of toxic or aggressive compounds (ozone and nitrogen oxides, among others), considerable energy saving during permanent or intensive use. The proof of the reality of such improvements is given by measurements made on an experimental model of the device according to the invention:

measurements in a Faraday cage of the total flux emitted toward the atmosphere, detected by an electronic probe of the polar diagram of ionic emission into free space, spectroscopic analysis with chemiluminescence of the air taken from the immediate vicinity of the points.

This assembly of measurements verifies and confirms completely each of the mentioned advantages characterizing the new device according to the invention.

The accompanying drawings illustrate an embodiment of the device of the invention, namely:

Figure 2:
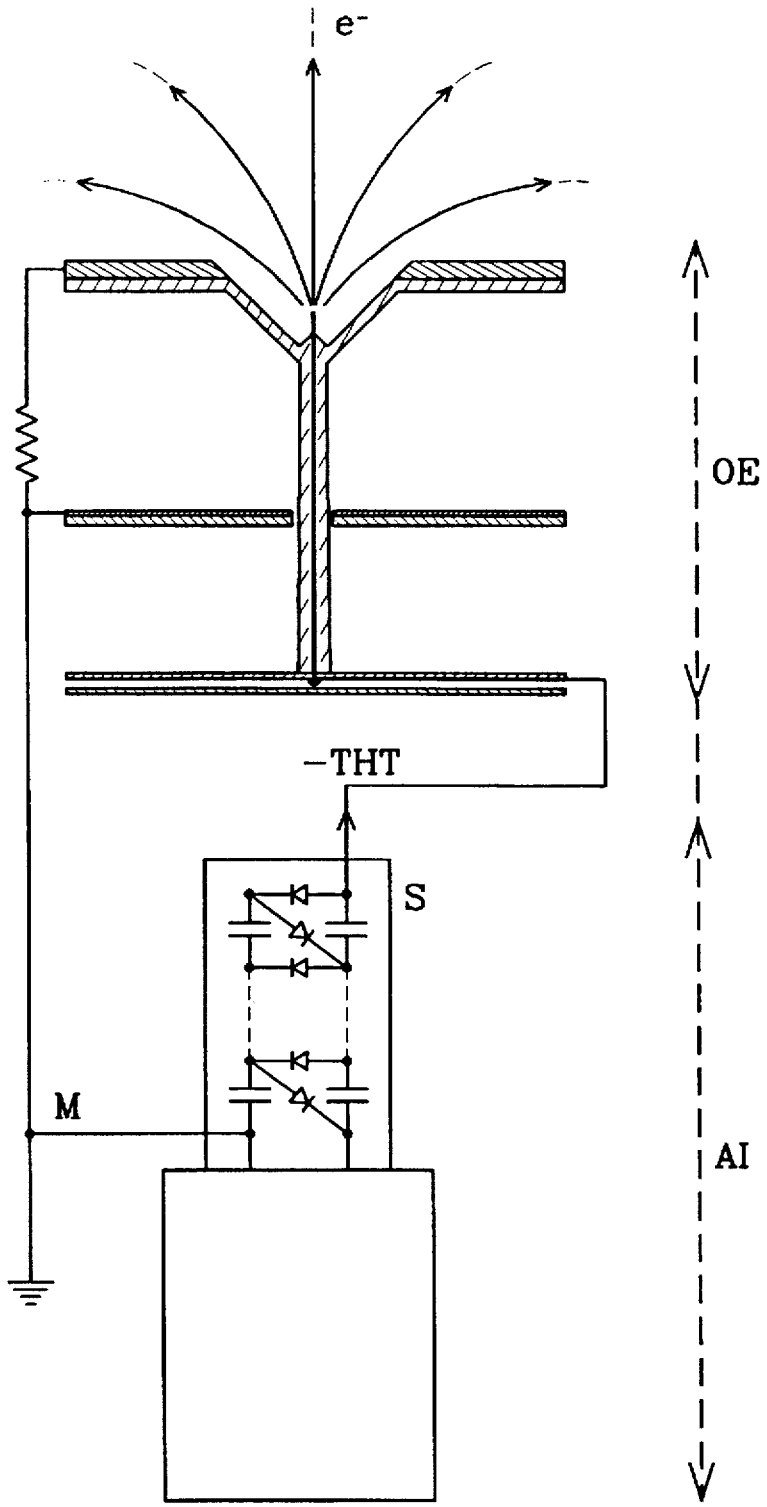
FIG. 2 shows the diagram (synoptic) of the assembly of the device in the form of specific functions exerted by each of its parts.

As is shown in FIG. 2, the assembly of the device according to the invention comprises two subassemblies:

one subassembly (section I) constituted by the optical electronic system, described above, according to FIG. 1.

a subassembly (section II) constituted by a supply block (AI) delivering between the output (S) and the common mass (M) a high voltage (−THT) of the order of 4 to 5 kV under an impedance of the order of about 100 Mohms, adapted to supply to said electronic optics the high voltage necessary for the ionic production.

Figure 1:
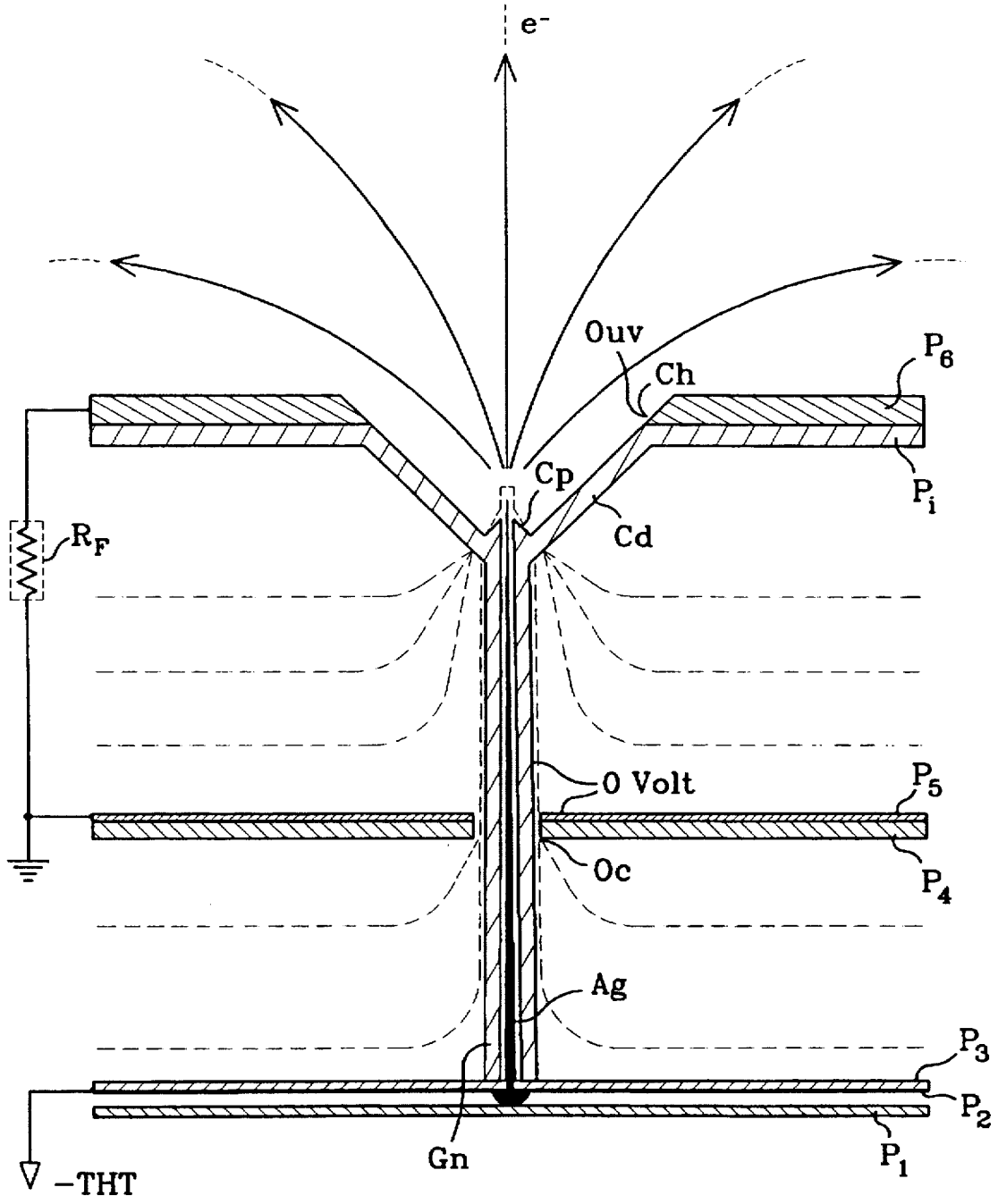
FIG. 1 is a schematic diagram of the principle of the elements of the new electronic optics, with the distribution of the equipotentials and of the emitted ionic flux.

As is shown in FIG. 1, the "electronic optic" portion of the device is thus constituted by:

a plate ($P_1$) of insulating material, of a thickness of the order of 1 mm, cancelling all electronic emission (outflow) toward the rear of the device at the interior of the housing;

a conductive plate ($P_2$) on which are secured on the rear surface (by welding, locking or any other securement means) the emission "points";

an insulating plate ($P_3$) secured to the plate ($P_2$) and located before the latter, the unitary assembly ($P_2$, $P_3$) having a thickness of 16/10 mm;

"points" constituted by long thin needles of inoxidizable metal (Ag) whose free end (emissive) has a radius of several micrometers;

an electronic emission adaptive structure constituted:

of a dielectric "sheath" (Gn), made of a material of high resistivity ($\geqq 10^{15}$ Ωm), of low loss and of relatively high permissivity, of an external diameter of the order of 5 mm, of an internal diameter permitting the passage of the needles. Said sheath is threaded with light friction on each needle, exposing on the latter only about 2 mm beyond the first terminal conical section constituting the end of said sheath, and coming into contact with the plate ($P_3$) at its other end;

a double conical structure secured to the sheath, made of the same insulating material as the latter, whose proximal portion ($C_p$) surrounds the end of the needle except of the last two millimeters that remain free, thereby achieving the confinement of the plasma, and whose flared distal portion ($C_d$) of an angular opening of 45° and of a depth of 8 mm, ensures a first complete and rapid diffusion of the ionic flux toward the ambient atmosphere;

an internal flat structure, plate ($P_i$) secured to the conical structure and extending the latter, of a thickness of 2 mm, made of the same insulating material, and fixed to the external wall of the housing enclosing the device, such that the conical openings of the adaptive structure come into exact coincidence with the circular openings (base of the chamfer) of said housing;

a composite plate ($P_4$, $P_5$) of 16/10 mm thickness, whose lower surface is insulating, the upper surface is conductive and connected to the mass (zero potential of the ground). Said plate is pierced by circular openings ($O_c$), ensuring exactly the passage with light friction of the "sleeves" of the emissive needles on which it is threaded;

a plate ($P_6$), whose thickness is of the order of 3 mm.l constitutes the housing enclosing the device, and is made of a very low conductive material (resistivity of the order of $10^7$ Ohm.square). Said plate constituting said housing is connected to the conductive plate ($P_5$). The resistance ($R_f$) of "loss" symbolizes the real resistance of the charged plate ($P_5$) for conducting the charges ($I_f$) taken from the local space charge resulting from the electronic emission of the points. Said plate ($P_6$) is pierced with circular openings (Ouv) provided with a chamfer (Ch) of angular opening of the order of 60°, hollowed out over all its thickness, such that its lower surface is adjusted exactly on the open end of the cone ($C_d$) carried by the internal plate ($P_i$), the wall of the chamfer (Ch) being located in the extension of the conical surface of the distal structure ($C_d$).

FIG. 2 shows an example of a possible embodiment of the electronic optical system adapted to the production and emission toward the atmosphere of the ion flux emitted by the "points".

An assembly of needles, whose length is of the order of 25 to 30 mm with a diameter of the order of 1 mm and a terminal radius of the order of several micrometers, is fixed on the conductive plate ($P_2$), subjected by the mentioned supply (AI) to a negative voltage (in the case of the production of negative oxygen ions in the air) of about 4.5 kV maximum.

The conductive field plate ($P_5$) carried by the insulating plate ($P_4$) is connected to the mass (potential zero). The emission needles are sheathed with a dielectric. As a result, equipotential zero is imposed by the field plate ($P_5$), its distribution depending thus on the position and on the length of the needles as well as the characteristics of the dielectric sheath and of its distal cone ($C_d$). In fact, because of the relatively high permissivity of the sheath and of its distal cone, the "folding back" of the equipotential zero takes place practically over the external surface of said sheath and ensures the presence of an electrical field of very high maximum value at the level of the free end of the needle, which condition is indispensable to the most intense possible primary electronic emission.

The plate ($P_6$) constituting the housing of the device has a low conductivity which however is not zero. This characteristic greatly reduces the capture of the charges emitted, whilst ensuring their evacuation toward the common mass. The optimum dynamic equilibrium between capture and evacuation thus results from the choice of the value of said conductivity and of the characteristics of the adaptive structure. The superficial charge acquired by the distal cone ($C_d$) exerts a strongly repulsive effect on the local space charge, ensuring emission toward the exterior of the maximum ionic flux of which only a very small part is captured by the housing. The measurement of said "capture current" on the experimental model mentioned above confirms the exactness of the measurement and the effectiveness of the device.

Such an embodiment is in no way the extent of the invention, whose different constituent elements can be made, as needed, in several portions and dimensions and suitable materials, assembled in the final device, or made in whole or in part in the form of molded pieces having characteristics and functions of the mentioned parts, in the functional form of a "electronic optical unitary module". The assembly of a predetermined number of such "unitary modules" by simple juxtaposition or by molding of the assembly permits having a "composite electronic optic in a sheet" adapted to the uses defined above.

An example of application is given by the use of the device in all the regions subject to pollution or biocontamination of the air; this is particularly the case in infant cribs. Tests carried out among numerous establishments have shown that the injection of a sufficient negative ionic flux ensures thus the precipitation of the polluting particles and of the germs that are present, as well as the death of these latter, with the corollary that there is a significant and lasting improvement of the sanitary state of the occupants.

Another example of application is localities subjected to strong influences of static charges existing or created by certain apparatus: this among others is the case of computer rooms in general, rooms for the handling or processing of photographic films as well as sensitive electronic components. The injection of a sufficient permanent flux of negative charge permits suppressing almost entirely the observed nuisances, without prejudice to the people present nor to sensitive materials.

Another example of application is given by the injection of an intense negative ionic flux into air inlet conduits for explosion motors or internal combustion engines. The negatively charged air ensures better stability and more complete combustion of the hydrocarbon spray, and because of this less emission of pollutants in the exhaust gas.

Such examples are in no way all the applications of the invention, which can be used in all circumstances requiring the production of intense ion fluxes (in particular negative) in aerial or gaseous media, in the complete absence of aggressive or toxic compounds (ozone or nitrogen oxides) for people and for goods.

I claim:

1. Generator of positive or negative ions in a gaseous medium, comprising an electronic optic (OE) constituted by at least one emissive needle or point (Ag) disposed in a system of support and acceleration plates, for focussing and diffusing the ions comprising a first conductive plate ($P_2$) on which is secured the non-emissive end of the needle, a second conductive plate ($P_5$) traversed by said needle and provided, on its surface turned toward said first conductive plate ($P_2$), with an insulating plate ($P_4$), said first and second conductive plates being connected to a suitable high voltage electrical source (AI) and an insulating plate arranged at the height of the emissive end of the needle and ensuring the diffusion of the electrons emitted by the needle, characterized in that the needle (Ag) comprising a coaxial sheath (Gn) of a dielectric material with high resistivity, low loss and relatively high permissivity, in that the portion of said sheath (Gn) located on the side of the emissive end of the needle (Ag) is extended by a first conical proximal section (Cp) of the same material as the sheath and leaving exposed said emissive end, in that said proximal section (Cp) is extended by an open conical distal structure (Cd) of the same material as the sheath, in that said distal conical section (Cd) is extended by a plate (Pi) of the same material as the sleeve and constituting with the distal conical structure (Cd) said diffusion plate of the electrons and in that said extending plate (Pi) is fixed below a plate (P6) of material of very low electrical conductivity, adapted to form a portion of the external housing of the generator.

2. Generator according to claim 1, characterized in that it comprises a plate ($P_1$) connected below said first conductive plate ($P_2$) at ends for protection against possible outflow of said conductive plate.

3. Generator according to claim 1, characterized in that said first conductive plate ($P_2$) comprises an insulating plate ($P_3$) on its surface turned toward the needle.

4. Generator according to claim 1, characterized in that said second conductive plate ($P_5$) comprises an insulating plate ($P_4$) on its surface turned toward said first conductive plate ($P_2$).

5. Generator according to claim 1, characterized in that said second conductive plate ($P_5$) and if desired the associated insulating plate ($P_4$) are provided with openings (Oc) of a diameter corresponding to that of the sheath of the needle (Ag) so as to permit the passage with slight friction of the sleeve on which said plates ($P_5$, $P_4$) are threaded.

6. Generator according to claim 1, characterized in that said plate ($P_6$) with very low electrical conductivity, adapted to form a portion of the external housing of the generator, is provided with a chamfered opening (Ouv, Ch) whose truncated conical wall is in prolongation of the conical surface of said distal conical structure (Cd).

7. Generator according to claim 1, characterized in that said second conductive plate ($P_5$) is at the zero potential of the general mass of the device.

8. Generator according to claim 7, characterized in that said plate ($P_6$) of very low electrical conductivity adapted to form a portion of the external housing of the generator is electrically connected to said conductive second plate ($P_5$) by a resistance of equivalent loss ($R_F$).

9. Generator according to claim 1, characterized in that the material of the sheath (Gn) has a resistivity greater than or equal to $10^{15}$ Ω.m.

10. Generator according to claim 1, characterized in that said needle (Ag) is left uncovered by said conical proximal section (Cp) over a length of the order of two mm.

11. Generator according to claim 1, characterized in that said distal conical structure (Cd) has an angular opening of the order of 45° and a depth of the order of 8 mm.

12. Generator according to claim 1, characterized in that said plate ($P_6$) with very low electrical conductivity is constituted of a material whose resistivity is of the order of $10^7$ Ohm.square.

13. Generator according to claim 1, characterized in that said high voltage electrical source supplies a voltage of the order of 4 Kv.

* * * * *